US005566689A

United States Patent [19]

Yeater

[11] Patent Number: 5,566,689

[45] Date of Patent: Oct. 22, 1996

[54] HAIR-CONTAINING DEVICE

[76] Inventor: Joan E. Yeater, 28-1/2 Fleet St., Marina Del Ray, Calif. 90292

[21] Appl. No.: 333,230

[22] Filed: Nov. 2, 1994

[51] Int. Cl.[6] ..... A45D 7/02

[52] U.S. Cl. ..... 132/212; 132/200; 2/174; 2/202

[58] Field of Search ..... 132/212, 270, 132/200; 2/174, 202

[56] References Cited

U.S. PATENT DOCUMENTS

| | | | |
|---|---|---|---|
| 2,817,090 | 12/1957 | Toellner | 2/174 |
| 3,962,728 | 6/1976 | Pavlinik | 2/174 |
| 4,190,907 | 3/1980 | Cruickshank | 2/202 |
| 4,441,214 | 4/1984 | Werner et al. | 132/212 |
| 4,683,596 | 8/1987 | Cole | 2/174 |
| 5,099,865 | 3/1992 | Flannery et al. | 132/212 |
| 5,203,358 | 4/1993 | Eytcheson | 132/212 |

*Primary Examiner*—Gene Mancene
*Assistant Examiner*—Pedro Philogene
*Attorney, Agent, or Firm*—Robert E. Malm

[57] ABSTRACT

The hair-containing device is a device for managing the wet hair of a user and is comprised of a shaped fabric bag having a closed end and an open end and a front and a back, the bag being worn with the front of the open end in contact with the user's forehead and the back of the open end in contact with the nape of the user's neck, A slit in the front of the bag extending from the open end to a point intermediate between the open end and the closed end allows the opening in the bag to be increased for ease of use. The bag has a shape which results in the bag draping from the back of the user's head down along the user's neck and spine, The hair-containing device includes a fastening device for holding the open end of the shaded fabric bag in intimate contact with the user's head.

8 Claims, 1 Drawing Sheet

HAIR-CONTAINING DEVICE

BACKGROUND OF INVENTION

This invention relates generally to hair-controlling devices and more specifically to hair-controlling devices that are used in managing hair after it has been washed.

A variety of hair-protecting devices have been invented over the years which are designed to protect a woman's coiffure while taking a shower or sleeping. A typical example is U.S. Pat. No. 3,750,681 issued to Claunch which is essentially a bowl-shaped cap with a cut at the rear which permits the cap to be easily placed over the hair and then fastened and an elastic band around the perimeter of the cap that prevents the cap from slipping off the head. Hair protectors of the type described are typically made of a net material if they are to be used while sleeping and of a waterproof material if they are to be used while taking a shower.

Women generally find such designs unsatisfactory for managing hair after their hair has been washed. Instead, women typically utilize bath towels fastened turban style around their heads, as illustrated in countless movies during the last half century, while the dress or put on make-up.

There are a number of reasons why hair protectors of the type typified by Claunch have not satisfied this hair-managing need.

First of all, the hair protector is of rather limited volume and so constructed as to perch on top of the head with the hair packed underneath. These features present no particular difficulty when the hair is dry. However, with wet hair the situation is completely different. Compressing wet hair into the limited volume wet a hair protector can caused undesirable effects on the hair that make subsequent styling efforts more difficult. And the weight of wet hair, particularly for hair that is long, causes the hair protector to slide off the top of the head.

Second, the rear closure of the hair protector does not present any particular problem with dry hair. However, with wet hair, stuffing the hair into the hair protector and then fastening the closure at the back of the neck is not an easy task.

Third, hair protectors are typically made of either a net or waterproof material, both of which are unsatisfactory for managing wet hair. A more appropriate material for wet-hair control terry cloth or a similarly-absorbent material, but generally the top-of-the-head hair protectors do not support the use of such a heavy material.

BRIEF SUMMARY OF INVENTION

The hair-containing device is a device for managing the wet hair of a user and is comprised of a shaped fabric bag having a closed end and an open end and a front and a back, the bag being worn with the front of the open end in contact with the user's forehead and the back of the open end in contact with the nape of the user's neck. A slit in the front of the bag extending from the open end to a point intermediate between the open end and the closed end allows the opening in the bag to be increased for ease of use. The bag has a shape which results in the bag draping from the back of the user's head down along the user's neck and spine.

The hair-containing device includes a means for holding the open end of the shaped fabric bag in intimate contact with the user's head. Specifically, an enclosed passageway around the perimeter of the open end from one side of the slit to the other side together with a drawstring threaded through the passageway and having end portions that extend outside the passageway permits the hair-containing device to be comfortably and securely held in contact with the user's head by pulling the drawstring tight and tying the ends.

The hair-containing device further comprises a fastening means for attaching one side of the slit to the other side and a means for concealing the end portions of the drawstring that extend outside the passageway after the end portions have been tied together.

DESCRIPTION OF THE PREFERRED EMBODIMENT

Figure 1:
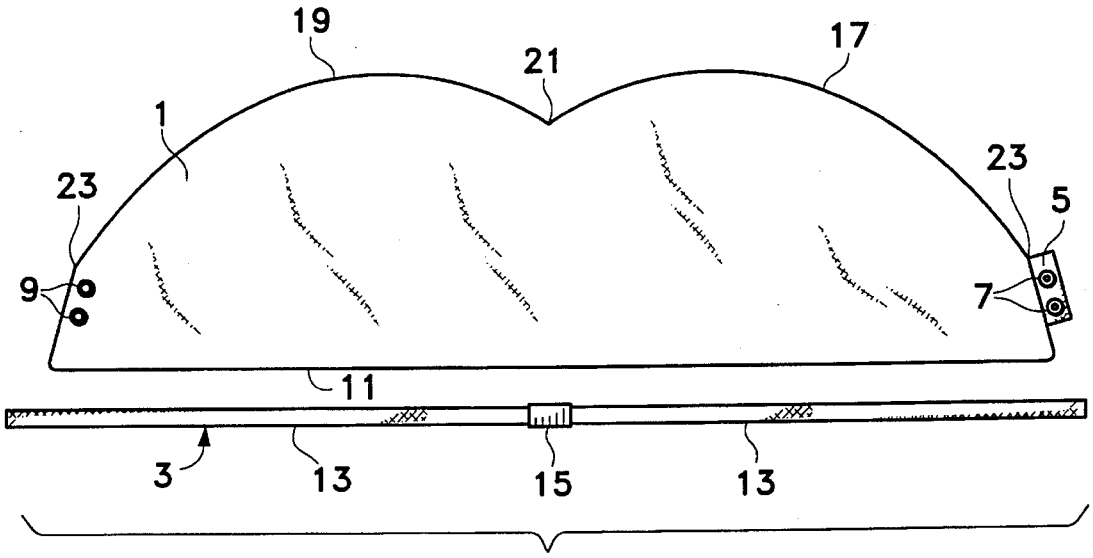
FIG. 1 is a drawing of the patterned piece of fabric which when sewn together becomes the hair-containing bag.

The preferred embodiment of the hair-containing device is fabricated from the patterned piece of fabric 1 and the drawstring 3 shown in FIG. 1. The patterned piece of fabric 1 is made of an absorbent material that is pervious to vapors. Terry cloth is one example of such a material. The advantages of using such a material for containing wet hair is that the hair remains damp enough to style, and the absorbed water cannot drip on the user's clothes. The fact that the material is pervious means that the evaporation of some of the water from the user's hair will be encouraged and will have a cooling effect on the user's head and suppress perspiration. The evaporation of the water from the user's hair is less than it would be in the open air. Consequently, it would be advantageous to use the hair-containing device after swimming to keep the head warm and avoid catching a cold.

A flap 5, made of the same material as the patterned piece of fabric 1 and containing two snap fastener male parts 7, is sewn to one edge of the patterned piece of fabric 1, and two female snap fastener parts 9 are attached to the opposite edge.

Typically, the length of the lower edge 11 of the patterned piece of fabric 1 is approximately 72 cm. The length of the flap 5 is approximately 20 cm. For a user with shoulder length hair, the height of the contoured edges above the lower edge, should be approximately 48 cm. For users with either longer or shorter hair, the height of the contoured edges may be adjusted accordingly.

The lower edge 11 of the patterned piece of fabric 1 is folded over and sewn to form a passageway through which a drawstring can be threaded.

The drawstring 3 is comprised of two fabric pieces 13 sewn at the ends to the elastic band 15. The fabric pieces 13 consist of a stiffening material covered with decorature cotton. The length of the elastic band should be approximately 8 cm. The drawstring 3 is passed through and centered in the passageway formed by folding over and sewing the lower edge 11. The material in the vicinity of the elastic band is gathered, and then the elastic band is sewn at its ends to the passageway fabric. The gathered material permits the elastic band to stretch within the passageway without constraint by the passageway material surrounding the elastic band.

The patterned piece of fabric 1 is symmetric with respect to a line of symmetry centered on and normal to the lower edge 11. A hair-containing bag is obtained by folding the patterned piece of fabric 1 at the line of symmetry on top of itself so that the contoured edge 17 lies on top of the contoured edge 19 and then sewing the layers together along the contoured edges between points 21 and 23. The resulting bag has a closed end and an open end with a slit extending from the open end to a point intermediate between the open and closed ends. The size of the open end is controlled by the drawstring. The slit permits easier access to the interior of the bag and enables a user to easily stuff her hair into the bag and place the bag over her head. All of the operations associated with using the hair-containing device are accomplished with the hands in front of the body, and there is no need to reach behind the head or neck to perform any fastening operations.

Figure 2:
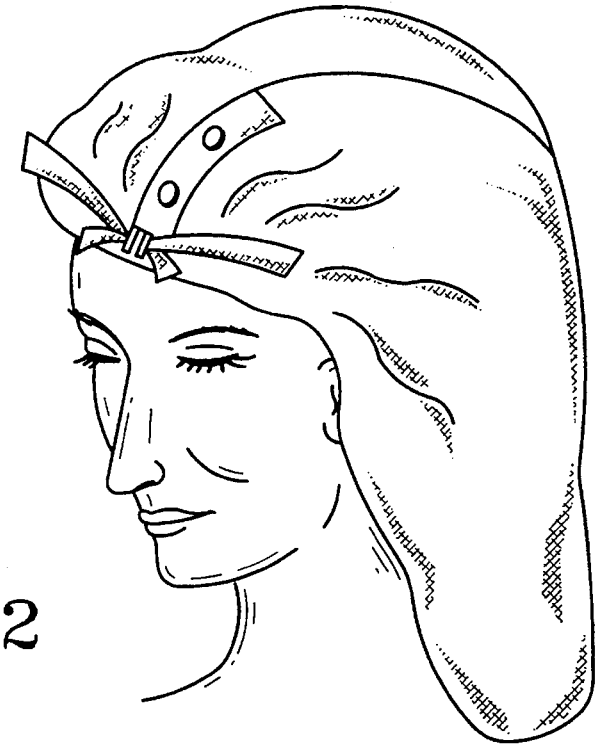
FIG. 2 is a drawing of a user wearing the hair-containing device.

A user places her hair in the hair-containing bag and fastens the bag to her head by performing the following operations. She first bends forward at the waist while at the same flipping her hair forward so that her hair hangs downward over her forehead. She then places the hair-containing bag over her head with the elastic band at the nape of her neck and tucks her hair into the bag. She then straightens up, flipping the hair-containing bag over her head as she does so, pulls the drawstring tight, and ties the ends in a bow. She completes the procedure by snapping the snap fastener male and female parts 7 and 9 together with the results as shown in FIG. 2. The user may, if she desires, tuck the bow underneath the flap 5 before snapping the snap fastener parts together thereby concealing the bow.

The hair-containing bag is shaped so that it drapes naturally from the back of the head along the neck and spine of the user. The hair is contained within the bag in much the same state as it would be if the bag were not there. The way in which the bag drapes results in the weight of the hair and the bag tending to pull the edge of the open end of the bag against the forehead rather than up and over the head. Thus, the bag will stay in place on the head during light physical activity such as putting on makeup, having a facial, performing light housework, taking a sauna or steambath, etc.

There are a number of alternatives for holding the hair-containing device in intimate contact with a user's head. The drawstring, for example, rather than being a combination of fabric and an elastic material, could be all fabric or all elastic. Rather than tying the ends of the drawstring, strips of Velcro could be used to attach the drawstring ends together. Strips of Velcro could also be used to attach the edges of the slit together rather than using snap fasteners. Instead of using a drawstring and snap fasteners, a stretched elastic band could be sewn around the perimeter of the open end of the hair-containing bag and Velcro strips used to attach the edges of the slit to each other. The Velcro strips would not only hold the slit edges together but would also maintain the elastic band in tension thereby causing the open end of the hair-containing bag to be held in intimate contact with the user's head.

What is claimed is:

1. A hair-containing device for managing the wet hair of a user, the hair-containing device comprising:

a shaped fabric bag having a closed end and an open end and a front and a back, the bag being worn with the front of the open end in contact with the user's forehead and the back of the open end in contact with the nape of the user's neck, a slit in the front of the bag extending from the open end to a point intermediate between the open end and the closed end, the bag having a shape which results in the bag draping from the top of the head to the neck and along the spine of the user when the bag is containing the user's hair and the open end encircles the user's head at the hair line;

a means for holding the open end of the shaped fabric bag in intimate contact with the user's head comprising an enclosed fabric passageway around the perimeter of the open end from one side of the slit to the other side and a drawstring threaded through the passageway and having end portions that extend outside the passageway, the size of the open end being fixed by tying the end portions of the drawstring together, the size of the one end being controlled by the lengths of the end portions extending outside the passageway.

2. The hair-containing device of claim 1 further comprising:

a means for concealing the end portions of the drawstring that extend outside the passageway after the end portions have been tied together.

3. The hair-containing device of claim 1 wherein the drawstring is comprised of at least one elastic portion.

4. The hair-containing device of claim 3 wherein the passageway fabric is gathered in at least one of the regions of the passageway where the elastic portions of the drawstring are located and the ends of the at least one elastic portion are fastened to the passageway fabric at each end of the at least one gathered region thereby permitting the at least one elastic portion to stretch without being constrained by the passageway fabric.

5. A method for making the hair-containing device of claim 1 comprising the steps:

cutting a patterned piece of fabric having a lower edge with left and right ends and adjoining contoured left and right upper edges, the contoured left edge having a left end, the contoured right edge having a right end, the piece of fabric being symmetrical with respect to a line centered on and normal to the lower edge;

folding the patterned piece of fabric along a line parallel to the lower edge to form two layers and sewing the two layers together to form a passageway for a drawstring;

folding the piece of fabric along the line centered on and normal to the lower edge to form two layers and sewing the two layers together along the contoured upper edges.

6. The method of claim 5 wherein the patterned piece of fabric has a left edge connecting the left end of the left contoured upper edge to the left end of the lower edge and a right edge connecting the right end of the right contoured upper edge to the right end of the lower edge, the method further comprising the steps:

attaching a means for fastening the left and right edges together.

7. The method of claim 5 further comprising the steps:

fabricating a drawstring;

threading the drawstring through the passageway.

8. A method of using the hair-containing device of claim 1 comprising the steps:

bending forward at the waist while at the same time flipping the hair forward so that it hangs downward over the forehead;

placing the hair-containing device over the head with the back of the opening in contact with the nape of the neck;

tucking the hair into the hair-containing device;

straightening up and at the same time flipping the hair-containing bag over the head;

pulling the drawstring tight and tying the ends;

fastening the edges of the slit together.

* * * * *